US012788062B2

(12) United States Patent
Frederick et al.

(10) Patent No.: US 12,788,062 B2
(45) Date of Patent: Nov. 10, 2026

(54) AEROSOL-FORMING CARTRIDGE AND SYSTEM WITH NICOTINE GEL

(71) Applicant: PHILIP MORRIS PRODUCTS S.A., Neuchâtel (CH)

(72) Inventors: Guillaume Frederick, Valff (FR); Oleg Mironov, Cudrefin (CH); Irene Taurino, Leuven (BE)

(73) Assignee: Philip Morris Products S.A., Neuchâtel (CH)

( * ) Notice: Subject to any disclaimer, the term of this patent is extended or adjusted under 35 U.S.C. 154(b) by 415 days.

(21) Appl. No.: 18/690,442

(22) PCT Filed: Sep. 2, 2022

(86) PCT No.: PCT/IB2022/058268
§ 371 (c)(1),
(2) Date: Mar. 8, 2024

(87) PCT Pub. No.: WO2023/037214
PCT Pub. Date: Mar. 16, 2023

(65) Prior Publication Data

US 2024/0365865 A1 Nov. 7, 2024

(30) Foreign Application Priority Data

Sep. 9, 2021 (EP) ..... 21195767

(51) Int. Cl.
*A24F 40/42* (2020.01)
*A24B 15/24* (2006.01)
(Continued)

(52) U.S. Cl.
CPC ..... *A24F 40/42* (2020.01); *A24B 15/243* (2013.01); *A24B 15/303* (2013.01); *A24B 15/32* (2013.01);
(Continued)

(58) Field of Classification Search
None
See application file for complete search history.

(56) References Cited

U.S. PATENT DOCUMENTS 4,183,365 A 1/1980 Kelley
2020/0288780 A1 9/2020 Martin et al.
2022/0330609 A1* 10/2022 Xie ..... A24F 40/30

FOREIGN PATENT DOCUMENTS

WO WO 2019/224531 A1 11/2019
WO WO 2020/176519 A1 9/2020
WO WO 2020/201706 A1 10/2020

OTHER PUBLICATIONS

European Search Report for EP 21195767.5, issued by the European Patent Office on Mar. 21, 2022; 5 pgs.
(Continued)

*Primary Examiner* — Cynthia Szewczyk
(74) *Attorney, Agent, or Firm* — Mueting Raasch Group

(57) ABSTRACT

An aerosol-forming cartridge includes a housing defining a cartridge body and having a housing interior, an aerosol-forming substrate reservoir fixed within the housing interior, and a revolver element rotatably fixed to the housing interior and having two or more chambers disposed about the revolver element. The aerosol-forming substrate reservoir contains a volume of aerosol-forming substrate. The aerosol-forming substrate is a gel. A bias element applies force to the volume of aerosol-forming substrate. The aerosol-forming substrate reservoir having an outlet aperture. The two or more chambers of the revolver are sequentially aligned with the outlet aperture as the revolver element rotates.

16 Claims, 2 Drawing Sheets

(51) Int. Cl.

| | |
|---|---|
| ***A24B 15/30*** | (2006.01) |
| ***A24B 15/32*** | (2006.01) |
| ***A24F 40/46*** | (2020.01) |
| ***A24F 40/485*** | (2020.01) |
| ***A24F 40/57*** | (2020.01) |
| ***A24F 40/85*** | (2020.01) |

(52) U.S. Cl.
CPC ..... *A24F 40/46* (2020.01); *A24F 40/485* (2020.01); *A24F 40/57* (2020.01); *A24F 40/85* (2020.01)

(56) References Cited

OTHER PUBLICATIONS

International Search Report and Written Opinion for PCT/IB2022/058268, issued by the European Patent Office on Nov. 4, 22; 15 pgs.

* cited by examiner

AEROSOL-FORMING CARTRIDGE AND SYSTEM WITH NICOTINE GEL

This application is the § 371 U.S. National Stage of International Application No. PCT/IB2022/058268, filed 2 Sep. 2022, which claims the priority to European App. No. 21195767.5, filed 9 Sep. 2021, the disclosures of which are incorporated by reference herein in their entireties.

The present disclosure relates to an aerosol-forming system with nicotine gel, the aerosol-forming system is configured to generate aerosol via heating of the nicotine gel.

Sensorial media of commercial electronic cigarettes are generally liquid (so called "e-liquids"). These e-liquids are typically contained in aerosol-forming articles or "pods" that are replaceable into the electronic cigarette. These pods include a heater in contact with a porous material or wick. This porous or wick transports e-liquid by capillarity action to the heater for vaporization into inhalation airflow of the electronic cigarettes.

A well-known problem of commercial electronic cigarettes is e-liquid leakage. Leakage occurs when there is too much e-liquid. Leakage occurs when the retention capability of the porous material does not prevent the e-liquid from flooding, especially in the case of full tank commercial electronic cigarettes. Leakage occurs when upon changes in environmental pressure during storage or transport. Leakage may also occur with temperature changes which affects the viscosity of the e-liquid and the retention capacity of the porous materials.

In addition, the heater of current commercial electronic cigarette systems is typically integrated in the replaceable cartridge or "pod" containing the e-liquid. Including the heater in the replaceable aerosol-forming article or "pod" increases the cost, complexity, and disposal costs of these replaceable aerosol-forming articles or "pods".

There is a need for an aerosol-forming cartridge or system that is stable and does not leak liquid. There is a need for a replaceable aerosol-forming article that does not include a heating element. There is a need for an aerosol-forming cartridge or system that provides a metered dose of aerosol-forming substrate during operation.

It is desirable to provide an aerosol-forming system that utilizes a gel aerosol-forming substrate in the replaceable aerosol-forming article. It is desirable to provide an aerosol-forming system that includes the heating element in the aerosol-forming device that receives the replaceable aerosol-forming article. It is desirable to provide an aerosol-forming article that includes the rotating revolver element having two or more chambers that receive a metered dose of aerosol-forming substrate or gel in each chamber. It is desirable to provide an aerosol-forming article that includes the rotating revolver element having at least three chambers and includes a heating position, a cleaning position, and a deposition position.

This disclosure is directed to an aerosol-forming article or cartridge that includes an aerosol-forming substrate reservoir and a rotating revolver element having two or more chambers that receive a metered dose of aerosol-forming substrate or gel in each chamber. The rotating revolver element includes at least, a heating position and a deposition position, and optionally a cleaning position.

According to an aspect of the present invention, there is provided an aerosol-forming cartridge includes a housing defining a cartridge body and having a housing interior, an aerosol-forming substrate reservoir fixed within the housing interior, and a revolver element rotatably fixed to the housing interior and having two or more chambers disposed about the revolver element.

The aerosol-forming substrate reservoir contains a volume of aerosol-forming substrate. The aerosol-forming substrate is a gel. A bias element applies force to the volume of aerosol-forming substrate. The aerosol-forming substrate reservoir having an outlet aperture. The two or more chambers of the revolver are sequentially aligned with the outlet aperture as the revolver element rotates.

According to another aspect of the present invention, an aerosol-forming system includes an aerosol-forming device and a replaceable cartridge or aerosol-forming article. The aerosol-forming device includes a device housing defining a device interior and a device exterior surface. The device exterior surface includes a cartridge receiving surface, and a heating element fixed to the cartridge receiving surface. The replaceable cartridge, described herein, is configured to mate with the cartridge receiving surface. The device heating element aligns with the revolver element in a gel heating position.

According to another aspect of the present invention, a method forming an aerosol includes inserting a replaceable cartridge, described herein onto the cartridge receiving surface of the aerosol-forming device, described herein. Then heating the aerosol-forming substrate contained within a chamber of the revolver element to form an aerosol in an inhalation airflow flowing through the cartridge. Then flowing the aerosol and inhalation airflow through a mouthpiece.

Advantageously, the aerosol-forming substrate in the aerosol-forming cartridge is a gel until the heating step and is thus stable and does not leak liquid during transport or storage or use of the aerosol-forming substate. In addition, the replaceable cartridge does not include a heating element and is less complex and less costly to produce. In addition, the replaceable cartridges provide a metered dose of aerosol-forming substrate per inhalation or puff as it is incremented forward from the deposition position to the heating position by the user. Advantageously, the revolver element has two or more chambers about the perimeter and the revolver element and rotates to provide, at least, a deposition position and a heating position to maintain the consistent operation of the aerosol-forming system, and optionally a cleaning position may be located between the heating position and the deposition position.

All values reported as a percentage are presumed to be weight percent based on the total weight.

All scientific and technical terms used herein have meanings commonly used in the art unless otherwise specified. The definitions provided herein are to facilitate understanding of certain terms used frequently herein.

As used herein, the singular forms "a", "an", and "the" encompass embodiments having plural referents, unless the content clearly dictates otherwise.

As used herein, "or" is generally employed in its sense including "and/or" unless the content clearly dictates otherwise. The term "and/or" means one or all the listed elements or a combination of any two or more of the listed elements.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

The term "substantially" as used here has the same meaning as "significantly," and can be understood to modify the relevant term by at least about 90%, at least about 95%, or at least about 98%. The term "not substantially" as used here has the same meaning as "not significantly," and can be understood to have the inverse meaning of "substantially," i.e., modifying the relevant term by not more than 10%, not more than 5%, or not more than 2%.

The terms "upstream" and "downstream" refer to relative positions of elements of the inhaler device and inhaler systems described in relation to the direction of inhalation air flow as it is drawn through the body of the inhaler device and inhaler systems.

The term "solid" refers to a fundamental state of matter that does not expand to fill a space or flow, at a temperature of 25 degrees Celsius and one atmosphere pressure.

The term "nicotine" refers to nicotine and nicotine derivatives such as free-base nicotine, nicotine salts and the like.

As used herein, the terms "control electronics", "controller" and "processor" refer to any device or apparatus capable of providing computing capabilities and control capabilities suitable, or configurable to perform the methods, process, and techniques described herein such as, for example, microprocessors, digital signal processors (DSP), application specific integrated circuits (ASIC), field-programmable gate arrays (FPGA), equivalent discrete or integrated logic circuitry, or any combination thereof and of providing suitable data storage capabilities that includes any medium (for example, volatile or non-volatile memory, or magnetic recordable medium such as a disk or tape) containing digital bits (for example, encoded in binary or trinary) that may be readable and writeable.

The term "aerosol" is used here to refer to a suspension of solid particles or liquid droplets, or a combination of solid particles and liquid droplets in a gas. The gas may be air. The solid particles or liquid droplets may comprise one or more volatile flavor compounds. Aerosol may be visible or invisible. Aerosol may include vapors of substances that are ordinarily liquid or solid at room temperature. Aerosol may include vapors of substances that are ordinarily liquid or solid at room temperature, in combination with solid particles or in combination with liquid droplets or in combination with both solid particles and liquid droplets. The aerosol preferably comprises nicotine.

The term "aerosol-forming substrate" is used here to refer to a material capable of releasing one or more volatile compounds that can form an aerosol. In some embodiments, an aerosol-forming substrate may be heated to volatilize one or more components of the aerosol-forming substrate to form an aerosol. In some cases, volatile compounds may be released by a chemical reaction. Aerosol-forming substrate may be solid or liquid or may comprise both solid and liquid components such as a gel. Aerosol-forming substrate may be adsorbed, coated, impregnated, or otherwise loaded onto a carrier or support. Aerosol-forming substrate preferably comprises nicotine. Aerosol-forming substrate may comprise plant-based material. Aerosol-forming substrate may comprise tobacco. Aerosol-forming substrate may comprise a tobacco-containing material containing volatile tobacco flavor compounds, which are released from the aerosol-forming substrate upon heating. Aerosol-forming substrate may alternatively comprise a non-tobacco-containing material. Aerosol-forming substrate may comprise homogenized plant-based material. Aerosol-forming substrate may comprise homogenized tobacco material. Aerosol-forming substrate may comprise at least one aerosol-former. Aerosol-forming substrate may comprise other additives and ingredients, such as flavorants. The aerosol-forming substrate may comprise an active ingredient. The aerosol-forming substrate may be provided as part of an aerosol generating article. The aerosol-forming substrate may be provided in an aerosol-generating article.

The term "aerosol-generating article" is used here to refer to a disposable product capable of including (for example, holding, containing, having, or storing) aerosol-forming substrate. An aerosol-generating article may be capable of removably interfacing, or docking, with an aerosol generating device. This allows the aerosol-generating device to generate aerosol from the aerosol-forming substrate of the aerosol-generating article. An "aerosol-forming cartridge" is an example of an "aerosol-generating article".

The term "aerosol-generating device" is used here to refer to any device configured to be used or utilized with an aerosol forming substrate that releases volatile compounds to form an aerosol that may be inhaled by a user. The aerosol-generating device may be interfaced with an aerosol-generating article comprising the aerosol-forming substrate.

The term "heating element" is used here to refer to any device, apparatus, or portion thereof configured to provide heat, or heat energy, to an aerosol-generating article to release volatile compounds from the aerosol-generating article to form an aerosol.

The term "gel" refers to a gelled material. The gellified or gelled material may be a solid at room temperature. The gellified or gelled material may substantially maintain its shape and mass at room temperature. Room temperature in this context means 25 degrees Celsius. "Solid" in this context means that the material substantially maintains its shape and mass at room temperature and does not flow.

An aerosol-forming cartridge includes a housing defining a cartridge body and having a housing interior, an aerosol-forming substrate reservoir fixed within the housing interior, and a revolver element rotatably fixed to the housing interior and having two or more chambers disposed about the revolver element. The aerosol-forming substrate reservoir contains a volume of aerosol-forming substrate. The aerosol-forming substrate is a gel. A bias element applies force to the volume of aerosol-forming substrate. The aerosol-forming substrate reservoir having an outlet aperture. The two or more chambers of the revolver are sequentially aligned with the outlet aperture as the revolver element rotates.

The aerosol-generating substrate may include nicotine. Nicotine may be included in the aerosol-generating substrate in free base form or in salt form. The aerosol-generating substrate may comprise nicotine at a concentration of 1 wt-% or greater, 1.5 wt-% or greater, or 2 wt-% or greater. The aerosol-generating substrate may comprise nicotine at a 5 concentration of 4 wt-% or less, 3 wt-% or less, or 2.5 wt-% or less. In one embodiment, the aerosol-generating substrate comprises about 2 wt-% nicotine.

The aerosol-generating substrate is a gel that comprises an active ingredient and one or more gelling agents. The active ingredient may comprise nicotine. Nicotine may be included in the gel in a free base form or in salt form. The gel may comprise nicotine at a concentration of 1 wt-% or greater, 1.5 wt-% or greater, or 2 wt-% or greater. The gel may comprise nicotine at a concentration of 4 wt-% or less, 3 wt-% or less, or 2.5 wt-% or less. In one embodiment, the gel comprises about 2 wt-% nicotine. The one or more gelling agents may comprise a biopolymer. Examples of suitable biopolymers include polysaccharides, such as gellan gums (native, low acyl gellan gums and high acyl gellan gums), xanthan gum, alginates (alginic acid), agar (a mixture of agarose and agaropectin), agarose, guar gum, wax, and the like. The gel may comprise gelling agent at a concentration of 1 wt-% or greater, 1.5 wt-% or greater, or 2 wt-% or greater. The gel may comprise gelling agent at a concentration of 20 wt-% or less, 15 wt-% or less, or 10 wt-% or less.

The aerosol-generating substrate may include additional ingredients, such as flavorants, aerosol formers, water, compounds that assist gelling, and the like. The aerosol-generating substrate may comprise one or more flavorants. The one or more flavorants may comprise tobacco flavors. Examples of suitable tobacco flavors include synthetic and naturally derived tobacco components. Naturally derived tobacco components may include volatile flavors or flavor compounds obtained from tobacco plant material. Such components may be obtained by any suitable method, such as extraction, drying, milling, etc. Synthetic tobacco components may comprise flavor molecules found in tobacco leaves, such as beta-damascenone, alpha- and 3-oxo-alpha-ionone, beta- and 4-oxo-beta-ionone, theaspirone, 2-ethyl-3,5-dimethylpyrazine, phenylacetaldehyde, guaiacol, and furaneol. Other suitable flavorants include, for example, natural or synthetic menthol, peppermint, spearmint, coffee, tea, spices (such as cinnamon, clove, ginger, or combination thereof), cocoa, vanilla, fruit flavors, chocolate, *eucalyptus*, geranium, eugenol, agave, juniper, anethole, linalool, and any combination thereof.

The aerosol-generating substrate (for example, gel) may include glycerol. For example, the aerosol-generating substrate may comprise glycerol at a concentration of 50 wt-% or greater, 60 wt-% or greater, or 70 wt-% or greater. The aerosol-generating substrate may comprise glycerol at a concentration of 95 wt-% or less, 90 wt-% or less, or 80 wt-% or less. The aerosol-generating substrate may comprise glycerol at a concentration in a range from 50 wt-% to 95 wt-%, or in a range from 60 wt-% to 90 wt-%, or a range from 60 wt-% to 80 wt-%.

The aerosol-generating substrate may include water. For example, the aerosol-generating substrate may comprise water at a concentration of 10 wt-% or greater, 15 wt-% or greater, or 20 wt-% or greater. The aerosol-generating substrate may comprise water at a concentration of 25 wt-% or less, 20 wt-% or less, or 15 wt-% or less. In some embodiments, the aerosol-generating substrate is free or substantially free of water.

The aerosol-generating substrate may include a gel comprising one or more divalent cations. Examples of suitable divalent cations include compounds that comprise calcium, such as calcium lactate in solution. The divalent cation may be present in the gel at a concentration of 0.1 wt-% or greater, or 0.5 wt-% or greater. The divalent cation may be present in the gel at a concentration of 1 wt-% or less. In some embodiments the gel comprises one or more carboxylic acids. The carboxylic acid may comprise a ketone group. The carboxylic acid may have 10 carbon atoms or less. Preferably, the carboxylic acid has 5 carbon atoms. Preferably, the carboxylic acid is levulinic acid.

One example of a suitable aerosol-generating substrate is a gel comprising nicotine and one or more gelling agents. The gel may comprise from 1 wt-% to 4 wt-% nicotine. The gel may comprise from 1 wt-% to 7 wt-% gelling agent. The gel may comprise from 50 wt-% to 70 wt-% glycerol. The gel may comprise a flavorant, such as a tobacco-based extract. The gel composition may comprise a gelling agent forming a solid medium, glycerol dispersed in the solid medium, and nicotine dispersed in the glycerol.

The housing defines a cartridge body having a housing exterior surface and an interior surface defining a housing interior. The housing may further define at least one air inlet and at least one air outlet. An airflow path extends between the least one air inlet and at least one air outlet. The revolver element is disposed along the airflow path to entrain aerosol formed by the revolver element in the heating position. When aerosol is inhaled by a consumer of the aerosol-forming device, air enters the housing through the at least one air inlet, pass though the housing interior and along the airflow path, and leave the housing through the at least one air outlet. The air outlet may form at least a portion of the mouthpiece. The housing or cartridge body may include a mouthpiece that is formed by the at least one air outlet. The housing or cartridge body may include a mouthpiece that is in fluid connection with the at least one air outlet.

An aerosol-forming substrate reservoir is contained within the housing or cartridge body. The housing interior surface may surround the aerosol-forming substrate reservoir. The aerosol-forming substrate reservoir contains a volume of aerosol-forming substrate. The aerosol-forming substrate reservoir contains a volume of aerosol-forming substrate sufficient to form 200 to 300 inhalations or puffs by a consumer. The aerosol-forming substrate reservoir has an outlet aperture.

A bias element applies force or pressure to the volume of aerosol-forming substrate. Force or pressure is sufficient to flow the volume of aerosol-forming substrate towards and through the outlet aperture. Force or pressure is sufficient to flow the volume of solid gel towards and through the outlet aperture. The bias element force may be provided by a spring element pushing against a surface of the volume of aerosol-forming substrate. The bias element force may be provided by a motor which pushes against a surface of the volume of aerosol-forming substrate directly or indirectly. The bias element force may be provided by mechanically pushing against a surface of the volume of aerosol-forming substrate directly or indirectly.

The revolver element is rotatably fixed to the housing interior. The revolver element has two or more chambers disposed about the revolver element. The revolver element may define a flat disc shape with an axis of rotation at the center of the flat disc. The two or more chambers of the revolver element are sequentially aligned with the outlet aperture as the revolver element rotates. Each of the chambers sequentially receive a defined volume of aerosol-forming substrate as the aerosol-forming system operates. The revolver element may rotate in a clockwise manner or a counter clockwise manner.

At least one chamber aligns with the outlet aperture and is filled with aerosol-forming substrate by the bias element applies force or pressure to the volume of aerosol-forming substrate in the aerosol-forming substrate reservoir, and at least one chamber, containing aerosol-forming substrate, is aligned in a heating position. In the heating position, the chamber containing aerosol-forming substrate is aligned with a heating element that may extend through the housing or may be fixed to the aerosol-forming device when mated with the aerosol-forming device. The chambers may extend through the thickness of the revolver element. The chambers may extend through the entire thickness of the revolver element forming an open aperture through the entire thickness of the revolver element. The chambers may extend through only a portion of the thickness of the revolver element forming a cavity with a bottom wall and side walls defining only a portion of the thickness of the revolver element.

The revolver element may include three chambers disposed about the revolver element. The three chambers may be equally spaced apart from each other around the perimeter of the revolver element. The three chambers of the revolver element are sequentially aligned with the outlet aperture as the revolver element rotates. Each of the chambers sequentially receive a defined volume of aerosol-forming substrate as the aerosol-forming system operates.

The revolver element with three chambers includes a cleaning position. The chamber aligned in the cleaning position has just rotated away from the heating position and may have residue remaining in the chamber. In the cleaning position that residue is removed by mechanical or thermal cleaning. The residue may be removed mechanically with a brush element within the housing or cartridge body. The residue may be removed thermally by a second heating element aligned with the chamber with residue in the cleaning position. The chamber with residue may be thermally cleaned by means of pyrolysis to decompose the residue within the chamber. Thermal cleaning may be accomplished by heating the chamber with residue to a temperature in a range from 400 degrees to 1000 degrees Celsius. The housing interior may define a separate cavity surrounding the cleaning position and a separate cleaning air outlet to prevent high temperature volatiles from entering the airflow path to the consumer during consumption.

The revolver element with three chambers includes a deposition position, a heating position, and a cleaning position. The three chambers align with each of the three positions and rotate sequentially through each of the three positions as the revolver element rotates one complete rotation or 360 degrees.

Initially, the first chamber aligns with the outlet aperture to receive aerosol-forming substrate, the second chamber containing aerosol-forming substrate aligns with the heating position, the third chamber containing residue is aligned in the cleaning position. When the aerosol-forming cartridge is mated with the aerosol-forming device, the consumer may activate the heating element and inhale the aerosol with an inhalation puff. Then the consumer may advance the revolver element one increment to move the first chamber containing aerosol-forming substrate to the heating position, and the second chamber with residue into the cleaning position, and the cleaned third chamber into the deposition position. This method is repeated after every inhalation by the consumer. This provides the consumer a uniform metered dose of aerosol with each inhalation.

An aerosol-forming system includes the cartridge, described above, mated with an aerosol-forming device. The aerosol-forming device includes a device housing defining a device interior and a device exterior surface. The device exterior surface comprises a cartridge receiving surface. The device housing includes a heating element fixed to the cartridge receiving surface. The cartridge is replaceably fixed or mated with the cartridge receiving surface. The heating element aligns with the revolver element in a heating position.

The cartridge receiving surface, or the surface of the cartridge contacting the cartridge receiving surface may include a detent element or securing element to hold the cartridge in place on the cartridge receiving surface. The revolver element may include a shaft coupled to a driving element in the aerosol-forming device configured to rotate the revolver element. The shaft is located along the axis of rotation of the revolver element. The cartridge receiving surface may include an aperture for receiving the shaft.

The driving element may include a motor. The driving element may be coupled to the shaft by a gear element. The driving element may be electrically coupled to control electronics. The driving element may be electrically coupled to the power supply.

The heating element may be a resistive heater or an inductive heater. The heating element may be electrically coupled to control electronics. The heating element may be electrically coupled to the power supply.

The heating element is configured to heat the aerosol-forming substrate to at least 200 degrees Celsius within 300 milliseconds. The heating element is configured to heat the aerosol-forming substrate to at least 200 degrees Celsius within 200 milliseconds. The heating element is configured to heat the aerosol-forming substrate to at least 250 degrees Celsius within 200 milliseconds, or within 100 milliseconds, or within 50 milliseconds, or within 25 milliseconds.

The aerosol-generating device may include a controller or control electronics comprising one or more processors (for example, microprocessors). The one or more processors may operate with associated data storage, or memory, for access to processing programs or routines and one or more types of data that may be employed to carry out the illustrative methods. For example, processing programs or routines stored in data storage may include programs or routines for controlling the one or more of the heating elements, driving element, and optional cleaning second heating element, individually controlling one or more of the driving or heating elements, implementing programs or schemes using one or more of the driving or heating elements, and the like.

The computer program products used to implement the processes described herein may be provided using any programmable language, for example, a high-level procedural or object orientated programming language that is suitable for communicating with a computer system. Any such program products may, for example, be stored on any suitable device, for example, a storage media, readable by a general or special purpose program, controller apparatus for configuring and operating the computer when the suitable device is read for performing the procedures described herein. In other words, at least in one embodiment, the aerosol-generating device may be implemented using a non-transitory computer readable storage medium, configured with a computer program, where the storage medium so configured causes the computer to operate in a specific and predefined manner to perform functions described herein.

The exact configuration of the controller of the aerosol-generating device is not limiting and essentially any device capable of providing suitable computing capabilities and control capabilities to implement the method may be used. In view of the above, it will be readily apparent that the functionality may be implemented in any manner as would be known to one skilled in the art. As such, the computer language, the controller, or any other software/hardware which is to be used to implement the processes described herein shall not be limiting on the scope of the systems, processes, or programs (for example, the functionality provided by such processes or programs) described herein. The methods and processes described in this disclosure, including those attributed to the systems, or various constituent components, may be implemented, at least in part, in hardware, software, firmware, or any combination thereof. For example, various embodiments of the techniques may be implemented within one or more processors, including one or more microprocessors, DSPs, ASICs, FPGAs, CPLDs, microcontrollers, or any other equivalent integrated or discrete logic circuitry, as well as any combinations of such components. When implemented in software, the functionality ascribed to the systems, devices, and methods described in this disclosure may be embodied as instructions on a computer-readable medium such as RAM, ROM, NVRAM, EEPROM, FLASH memory, magnetic data storage media, optical data storage media, or the like. The instructions may be executed by one or more processors to support one or more embodiments of the functionality.

The aerosol-forming device may include a second heating element positioned on the cartridge receiving surface to align with a cleaning position of the revolver element. The second heating element is configured to heat to a temperature of 400 degrees Celsius to clean the residue from the chamber aligned with the second heating element. The second heating element is configured to heat to a temperature in a range from 400 degrees to 600 degrees to clean the residue from the chamber aligned with the second heating element. The second heating element is configured to heat to a temperature in a range from 400 degrees to 1000 degrees Celsius to clean the residue from the chamber aligned with the second heating element.

The second heating element may be a resistive heater or an inductive heater. The second heating element may be electrically coupled to control electronics. The second heating element may be electrically coupled to the power supply.

A method of forming an aerosol includes inserting a cartridge, described above, onto the cartridge receiving surface of the aerosol-forming device, described above. Heating the aerosol-forming substrate contained within a chamber of the revolver element of the cartridge to form an aerosol in an inhalation airflow flowing through the cartridge and flowing the aerosol and inhalation airflow through a mouthpiece.

The method may further include rotating the revolver element one increment to align a chamber containing the aerosol-forming substrate or gel over the heating element in the heating position and aligning an empty chamber with the outlet aperture of the aerosol-forming substrate reservoir to deposit aerosol-forming substrate or gel into the empty chamber.

The method may further include rotating the revolver element one increment to align a chamber containing the aerosol-forming substrate or gel over the heating element in the heating position, aligning a chamber containing residue over a cleaning position and mechanically or thermally cleaning the chamber containing residue, and aligning an empty chamber with the outlet aperture of the aerosol-forming substrate reservoir to deposit gel into the empty chamber.

The method may further include replacing the cartridge with a new cartridge once the cartridge is depleted of gel. The cartridge may provide a consumer with 200 to 300 inhalations or puffs.

The invention is defined in the claims. However, below there is provided a non-exhaustive listing of non-limiting examples. Any one or more of the features of these examples may be combined with any one or more features of another example, embodiment, or aspect described herein.

Example Ex1. An aerosol-forming cartridge includes a housing defining a cartridge body and having a housing interior, an aerosol-forming substrate reservoir fixed within the housing interior, the aerosol-forming substrate reservoir containing a volume of aerosol-forming substrate, the aerosol-forming substrate being a gel, and a bias element applying force to the volume of aerosol-forming substrate, the aerosol-forming substrate reservoir having an outlet aperture, and a revolver element rotatably fixed to the housing interior and having two or more chambers disposed about the revolver element, the two or more chambers are sequentially aligned with the outlet aperture as the revolver element rotate.

Example Ex2. The aerosol-forming cartridge of Ex1, wherein the gel comprises nicotine.

Example Ex3. The aerosol-forming cartridge according to any preceding Example, wherein the gel comprises nicotine salt Example Ex4. The aerosol-forming cartridge according to any preceding Example, wherein the gel comprises one or more gelling agents comprising a biopolymer.

Example Ex5. The aerosol-forming cartridge according to any preceding Example, wherein the gel comprises glycerol.

Example Ex6. The aerosol-forming cartridge according to any preceding Example, wherein the gel comprises 50 wt % to 95 wt % glycerol.

Example Ex7. The aerosol-forming cartridge according to any preceding Example, wherein the revolver element comprises three chambers that extent through a thickness of the revolver element.

Example Ex8. The aerosol-forming cartridge according to any preceding Example, wherein the housing comprises an airflow path extending from an air inlet through the housing interior to an air outlet the housing, and the revolver is disposed along the airflow path.

Example Ex9. The aerosol-forming cartridge according to Ex8, wherein the air outlet forms at least a portion of a mouthpiece Example Ex10. The aerosol-forming cartridge according to any preceding Example, wherein the bias element comprises a spring.

Example Ex11. The aerosol-forming cartridge according to any preceding Example, wherein the revolver element comprises three chambers, wherein the first chamber aligns with the outlet aperture, the second chamber aligns in a heating position, and the third chamber aligns with a cleaning position.

Example Ex12. The aerosol-forming cartridge according to Ex11, wherein the third chamber aligns with a cleaning position is mechanically cleaned or thermally cleaned.

Example Ex13. An aerosol-forming system includes an aerosol-forming device having a device housing defining a device interior and a device exterior surface, the device exterior surface includes a cartridge receiving surface, a heating element fixed to the cartridge receiving surface, and a cartridge according to any preceding Example configured to mate with the cartridge receiving surface, wherein the heating element aligns with the revolver element in a gel heating position.

Example Ex14. The aerosol-forming system according to Ex13, wherein the revolver element comprises a shaft coupled to a driving element in the aerosol-forming device configured to rotate the revolver element.

Example Ex15. The aerosol-forming system according to Ex14, wherein the driving element and the heating element are electrically coupled to control electronics within the aerosol-forming device.

Example Ex16. The aerosol-forming system according to Ex14, wherein the driving element and the heating element are electrically coupled to a power supply within the aerosol-forming device.

Example Ex17. The aerosol-forming system according to any one of Ex13 to Ex16, wherein the heating element is a resistive heating element configured to heat the aerosol-forming substrate to 200 degrees C. within 300 milliseconds.

Example Ex18. The aerosol-forming system according to any one of Ex13 to Ex17, wherein the aerosol-forming device comprises a second heating element configured to align with a cleaning position of the revolver element.

Example Ex19. A method of forming an aerosol including, inserting a cartridge according to any one of Ex1 to Ex12 onto the cartridge receiving surface of the aerosol-forming device according to any one of Ex13 to Ex18, then heating the aerosol-forming substrate contained within a chamber of the revolver element to form an aerosol in an inhalation airflow flowing through the cartridge, and flowing the aerosol and inhalation airflow through a mouthpiece.

Example Ex20. The method of forming an aerosol according to Ex 19, further including rotating the revolver element one increment to align a chamber containing the gel over the heating element in the heating position and aligning an empty chamber with the outlet aperture of the aerosol-forming substrate reservoir to deposit gel into the empty chamber.

Example Ex21. The method of forming an aerosol according to Ex 19, further including replacing the cartridge with a new cartridge once the cartridge is depleted of gel.

Example Ex22. The method of forming an aerosol according to Ex 19, further including rotating the revolver element one increment to align a spent chamber with a brush or second heater to clean the chamber after forming the aerosol in an inhalation airflow flowing through the cartridge and forming a cleaned chamber.

The Examples will now be further described with reference to the figures in which.

Figure 1:
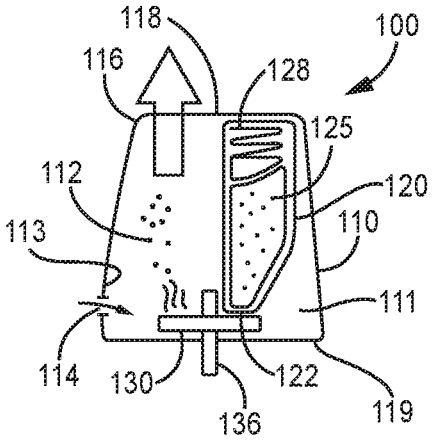
FIG. 1 is a schematic cross-sectional diagram of an illustrative aerosol-forming cartridge.

The schematic drawings are not necessarily to scale and are presented for purposes of illustration and not limitation. The drawings depict one or more aspects described in this disclosure. However, it will be understood that other aspects not depicted in the drawing fall within the scope and spirit of this disclosure.

Figure 2:
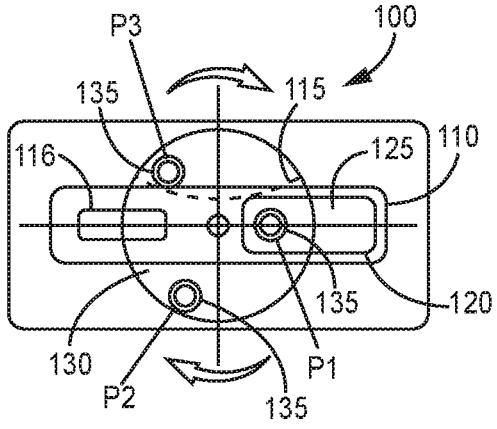
FIG. 2 is a transparent schematic top view of a portion of the aerosol-forming cartridge of FIG. 1.
Figure 3:
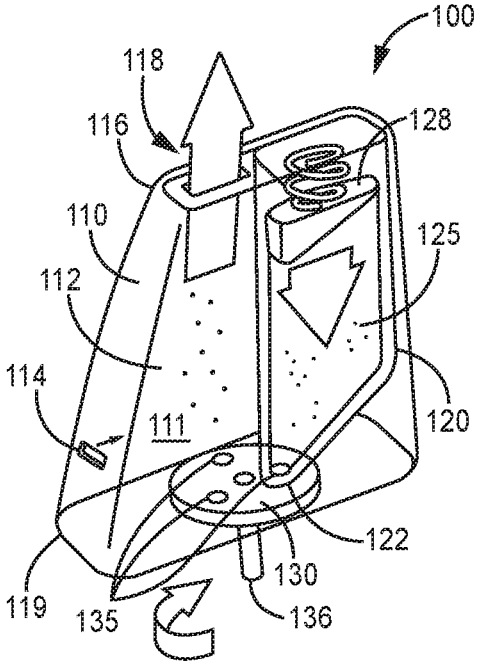
FIG. 3 is a transparent schematic perspective view of the aerosol-forming cartridge of FIG. 1.

FIG. 1 is a schematic cross-sectional diagram of an illustrative aerosol-forming cartridge 100. FIG. 2 is a transparent schematic top view of a portion of the aerosol-forming cartridge 100 of FIG. 1. FIG. 3 is a transparent schematic perspective view of the aerosol-forming cartridge 100 of FIG. 1.

An aerosol-forming cartridge 100 includes a housing 110 defining a cartridge body and having a housing interior 111 defined by an inner surface 113 of the housing 110. An aerosol-forming substrate reservoir 120 is fixed within the housing interior 111 to the inner surface 113. A revolver element 130 is rotatably fixed to the housing interior 111 to the inner surface 113. The revolver element 130 has three chambers 135 disposed about the revolver element 130. The aerosol-forming substrate reservoir 120 contains a volume of aerosol-forming substrate 125. The aerosol-forming substrate 125 is a gel. A bias element 128 applies force to the volume of aerosol-forming substrate 125. The aerosol-forming substrate reservoir 120 has an outlet aperture 122. The three chambers 135 of the revolver are sequentially aligned with the outlet aperture 122 as the rotates.

The revolver element 130 is a flat disc having a shaft 136 connected to the revolver element 130 at the axis of rotation of the revolver element 130. The bias element 128 is shown as a spring member that applies a force sufficient to cause the aerosol-forming substrate 125 to flow towards and out of the outlet aperture 122, depositing aerosol-forming substrate 125 into a chamber 135 aligned with the outlet aperture 122 at a depositing position P1. A second chamber 135 is located at the heating position P2 and a third chamber 135 is located at a cleaning position P3. The revolver element 130 rotates clockwise through the three positions P1, P2 and P3 when viewing the revolver element 130 from the top view.

The housing 110 includes an airflow path 112 extending from an air inlet 114 through the housing interior 111 to an air outlet 116 the housing. The revolver element 130 is disposed along the airflow path 112, to provide aerosol into the inhalation air flowing along the airflow path 112.

The aerosol-forming cartridge 100 includes an aerosol-forming device mating surface 119. The shaft 136 of the revolver element 130 extends through the aerosol-forming device mating surface 119. The revolver element 130 may be parallel with the aerosol-forming device mating surface 119. The aerosol-forming device mating surface 119 may include a heat conduction element configures to transfer heat from the device heating element to the chamber 135 located at the heating position P2.

The aerosol-forming cartridge 100 includes a mouthpiece 118. The air outlet 116 forms a portion of the mouthpiece 118.

The aerosol-forming cartridge 100 may include a separating wall 115 separating the cleaning position P3 cavity from the airflow path 112 as shown in FIG. 2. Thermal cleaning may be accomplished by heating the chamber 135 in the cleaning position P3 to a temperature in a range from 400 degrees to 1000 degrees Celsius. The separating wall 115 prevents high temperature volatiles that are cleaned from the chamber 135 from entering the airflow path 112 to the consumer during consumption.

Figure 4:
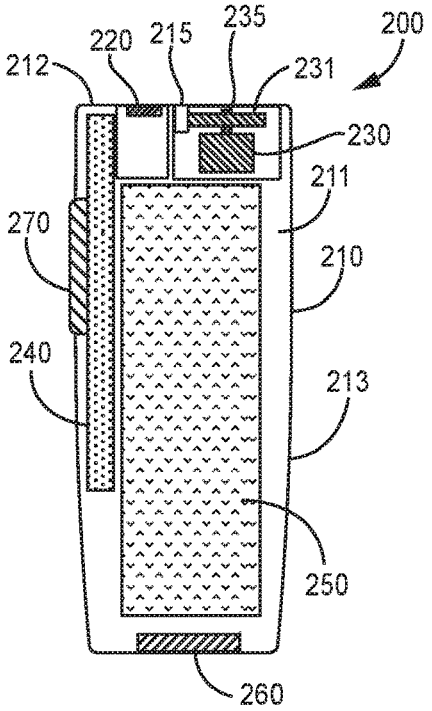
FIG. 4 is a schematic cross-sectional diagram of an illustrative aerosol-forming device.
Figure 5:
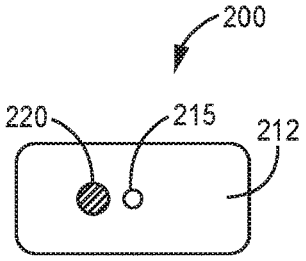
FIG. 5 is a schematic top view of the aerosol-forming device of FIG. 4.
Figure 6:
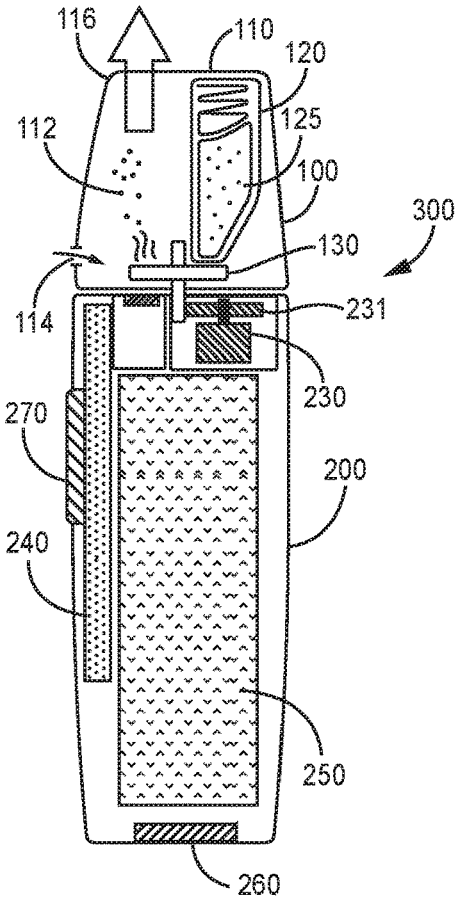
FIG. 6 is a schematic cross-sectional diagram of an illustrative aerosol-forming system including the aerosol-forming cartridge of FIG. 1 mated to the aerosol-forming device of FIG. 4.
Figure 7:
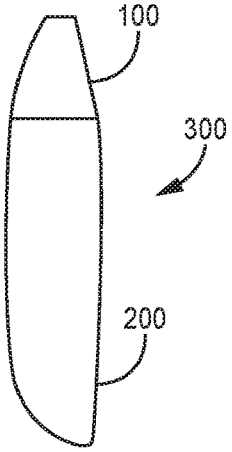
FIG. 7 is schematic side elevation view of the aerosol-forming system of FIG. 6.

FIG. 4 is a schematic cross-sectional diagram of an illustrative aerosol-forming device 200. FIG. 5 is a schematic top view of the aerosol-forming device 200 of FIG. 4. FIG. 6 is a schematic cross-sectional diagram of an illustrative aerosol-forming system 300 including the aerosol-forming cartridge 100 of FIG. 1 mated to the aerosol-forming device 200 of FIG. 4. FIG. 7 is schematic side elevation view of the aerosol-forming system 300 of FIG. 6.

The aerosol-forming device 200 includes a device housing 210 defining a device interior 211 and a device exterior surface 213, the device exterior surface 213 including a cartridge receiving surface 212. A heating element 220 is fixed to the cartridge receiving surface. A cartridge 100 mates with the cartridge receiving surface 212. The heating element 220 aligns with the revolver element 130 in a gel heating position P2.

The cartridge receiving surface 212 includes a shaft aperture 215 that is configured to receive the shaft 136 of the revolver element 130 once the cartridge 100 mates with the cartridge receiving surface 212. The shaft 136 is coupled to the driving element 230 such as a motor. The motor 230 includes a motor shaft 235 that is coupled to one or more gear elements 231 (illustrated here as a single gear for convenience). The driving element 230 is illustrated coupled to the shaft 136 by the gear elements 231. The driving element 230 rotates the revolver element 130 to provide aerosol-forming substrate 125 to the heating element 220.

Control electronics 240 and a power supply 250 are disposed within the device housing 210. The driving element 230 is electrically coupled to the control electronics 240. The driving element is electrically coupled to the power supply 250.

The aerosol-forming device 200 is illustrated including a charging port 260 electrically coupled to the power supply 250 to re-charge the power supply 250. The aerosol-forming device 200 is illustrated including a power switch and a display unit 270. The power switch and a display unit 270 is electrically coupled to the control electronics 240.

For the purpose of the present description and of the appended claims, except where otherwise indicated, all numbers expressing amounts, quantities, percentages, and so forth, are to be understood as being modified in all instances by the term "about." Also, all ranges include the maximum and minimum points disclosed and include any intermediate ranges therein, which may or may not be specifically enumerated herein. In this context, therefore, a number A is understood as A ±2% of A. Within this context, a number A may be considered to include numerical values that are within general standard error for the measurement of the property that the number A modifies. The number A, in some instances as used in the appended claims, may deviate by the percentages enumerated above provided that the amount by which A deviates does not materially affect the basic and novel characteristic(s) of the claimed invention. Also, all ranges include the maximum and minimum points disclosed and include any intermediate ranges therein, which may or may not be specifically enumerated herein.

The invention claimed is:

1. An aerosol-forming cartridge comprising:

a housing defining a cartridge body and having a housing interior;

an aerosol-forming substrate reservoir fixed within the housing interior, the aerosol-forming substrate reservoir containing a volume of aerosol-forming substrate, the aerosol-forming substrate being a gel, and a bias element applying force to the volume of aerosol-forming substrate, the aerosol-forming substrate reservoir having an outlet aperture; and a revolver element rotatably fixed to the housing interior and having two or more chambers disposed about the revolver element, the two or more chambers are sequentially aligned with the outlet aperture as the revolver element rotates.

2. The aerosol-forming cartridge according to claim 1, wherein the gel comprises nicotine or a nicotine salt.

3. The aerosol-forming cartridge according to claim 1, wherein the gel comprises one or more gelling agents comprising a biopolymer.

4. The aerosol-forming cartridge according to claim 1, wherein the gel comprises 50 wt % to 95 wt % glycerol.

5. The aerosol-forming cartridge according to claim 1, wherein the revolver element comprises three chambers that extent through a thickness of the revolver element.

6. The aerosol-forming cartridge according to claim 1, wherein the housing comprises an airflow path extending from an air inlet through the housing interior to an air outlet the housing, and the revolver is disposed along the airflow path, and the air outlet forms at least a portion of a mouthpiece.

7. The aerosol-forming cartridge according to claim 1, wherein the revolver element comprises three chambers, wherein a first chamber aligns with the outlet aperture, a second chamber aligns in a heating position, and a third chamber aligns with a cleaning position, wherein the third chamber aligns with a cleaning position is mechanically cleaned or thermally cleaned.

8. An aerosol-forming system comprising:

an aerosol-forming device comprising:

a device housing defining a device interior and a device exterior surface, the device exterior surface comprises a cartridge receiving surface;

a heating element fixed to the cartridge receiving surface; and a cartridge according to claim 1 configured to mate with the cartridge receiving surface;

wherein the heating element aligns with the revolver element in a gel heating position.

9. The aerosol-forming system according to claim 8, wherein the revolver element comprises a shaft coupled to a driving element in the aerosol-forming device configured to rotate the revolver element.

10. The aerosol-forming system according to claim 9, wherein the driving element and the heating element are electrically coupled to control electronics within the aerosol-forming device, and the driving element and the heating element are electrically coupled to a power supply within the aerosol-forming device.

11. The aerosol-forming system according to claim 8, wherein the heating element is a resistive heating element configured to heat the aerosol-forming substrate to 200 degrees C. within 300 milliseconds.

12. The aerosol-forming system according to claim 8, wherein the aerosol-forming device comprises a second heating element configured to align with a cleaning position of the revolver element.

13. A method of forming an aerosol, comprising:

inserting the aerosol-forming cartridge of claim 1 onto a cartridge receiving surface of an aerosol-forming device comprising a device housing defining a device interior and a device exterior surface, the device exterior surface comprises the cartridge receiving surface; a heating element fixed to the cartridge receiving surface, wherein the heating element aligns with the revolver element in a gel heating position;

heating the aerosol-forming substrate contained within a chamber of the revolver element to form an aerosol in an inhalation airflow flowing through the cartridge; and flowing the aerosol and inhalation airflow through a mouthpiece.

14. The method according to claim 13, further comprising rotating the revolver element one increment to align a chamber containing the aerosol-forming substrate over the heating element in the heating position and aligning an empty chamber with the aerosol-forming substrate outlet aperture of the aerosol-forming substrate reservoir to deposit aerosol-forming substrate into the empty chamber.

15. The method according to claim 13, further comprising rotating the revolver element one increment to align a chamber with residue with a brush or second heater to clean the chamber after forming the aerosol in an inhalation airflow flowing through the cartridge and forming a cleaned chamber.

16. The aerosol-forming cartridge according to claim 1, wherein the gel comprises one or more gelling agents comprising glycerol.

* * * * *